US010429789B2

(12) United States Patent
Karino

(10) Patent No.: US 10,429,789 B2
(45) Date of Patent: Oct. 1, 2019

(54) IMAGE FORMING APPARATUS IN WHICH UNEVEN IMAGE DENSITY IS SUPPRESSED WHILE SIMULTANEOUSLY FIXING FILM SURFACE LAYER IS PROTECTED

(71) Applicant: CANON KABUSHIKI KAISHA, Tokyo (JP)

(72) Inventor: Kenichi Karino, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/957,714

(22) Filed: Apr. 19, 2018

(65) Prior Publication Data

US 2018/0307177 A1 Oct. 25, 2018

(30) Foreign Application Priority Data

Apr. 25, 2017 (JP) ..... 2017-086451

(51) Int. Cl.
*G03G 15/20* (2006.01)
*G03G 15/00* (2006.01)

(52) U.S. Cl.
CPC ..... *G03G 15/80* (2013.01); *G03G 15/206* (2013.01); *G03G 15/2032* (2013.01); *G03G 15/2039* (2013.01); *G03G 15/2053* (2013.01)

(58) Field of Classification Search
None
See application file for complete search history.

(56) References Cited

U.S. PATENT DOCUMENTS

2011/0131434 A1* 6/2011 Nakaya ..... G03G 15/2039 713/320
2012/0243894 A1* 9/2012 Umeda ..... G03G 15/2032 399/68
2015/0086250 A1 3/2015 Hara et al.

FOREIGN PATENT DOCUMENTS

| | | | |
|---|---|---|---|
| JP | H04335386 | A | 11/1992 |
| JP | 2006-195003 | A | 7/2006 |
| JP | 2010-164636 | A | 7/2010 |
| JP | 2011232499 | A | 11/2011 |
| JP | 2014-115441 | A | 6/2014 |
| JP | 2015-084084 | A | 4/2015 |

* cited by examiner

*Primary Examiner* — Victor Verbitsky
(74) *Attorney, Agent, or Firm* — Canon U.S.A., Inc. IP Division

(57) ABSTRACT

An image forming apparatus of the present invention is provided with, between a commercial alternating power supply and a pressure roller, a conductive path which is different from a power supply path from the commercial alternating power supply to a heater, and with a capacitive element on the conductive path.

9 Claims, 6 Drawing Sheets

IMAGE FORMING APPARATUS IN WHICH UNEVEN IMAGE DENSITY IS SUPPRESSED WHILE SIMULTANEOUSLY FIXING FILM SURFACE LAYER IS PROTECTED

BACKGROUND OF THE INVENTION

Field of the Invention

The present invention relates to an image forming apparatus that forms an image on a recording material using an electrophotographic technology such as a copying machine or a laser printer.

Description of the Related Art

An image forming apparatus is mounted with a fixing unit. The fixing unit includes a tubular fixing film, a heater that comes in contact with an inner surface of the fixing film, a pressure roller that configures, together with the heater, a fixing nip portion via the fixing film. The fixing unit is configured to fix an unfixed toner image while the fixing nip portion is nipping and conveying a recording material. The heater to be used for fixing is configured to include a resistance heating element that is printed on a ceramic substrate and is covered with an insulating layer made of glass. Application of an alternating voltage to the resistance heating element causes the resistance heating element to generate heat. Since the glass that covers the resistance heating element becomes a capacitor in an equivalent circuit, an alternating voltage is transmitted to the fixing nip portion.

On the other hand, if a moisture content of a recording material to which a toner image is to be transferred rises, impedance of the recording material suddenly reduces. At a time when the recording material with a large moisture content is nipped simultaneously by the fixing nip portion and a transfer nip portion configured by a photosensitive drum and a transfer roller during printing, the alternating voltage applied to the fixing nip portion is transferred to the transfer nip portion via the recording material. The alternating voltage transmitted to the transfer nip portion that changes a transfer voltage on the transfer nip portion and thus causes transfer nonuniformity of a toner image. As a result, an uneven density portion of a stripe-pattern is generated on the toner image to be transferred to the recording material.

Japanese Patent Application Laid-Open No. 2006-195003 discusses a method for inserting a capacitor between a pressure roller or a fixing film and a ground potential to reduce alternating impedance between a fixing nip portion and the ground potential and for reducing an alternating voltage component to be transmitted to the transfer nip portion via the recording material.

If the heater and the pressure roller are left standing for a long time in a pressurized state, uneven deformed portion is generated on the fixing film or a rubber layer of the pressure roller. The deformed portion might cause nonuniformity in fixability of a toner image. In order to prevent this, in a certain apparatus, a slight gap is provided partially or entirely on the fixing nip portion so that a pressure to be applied to the fixing nip portion is released or reduced while the apparatus is not used.

A dielectric withstand voltage test which is defined by safety standards is necessarily conducted before shipment of an image forming apparatus. In the dielectric withstand voltage test, an alternating voltage which exceeds 1 kV is applied between the ground potential and an alternating voltage source that supplies electric power to the image forming apparatus. For example, as illustrated in FIG. 6, a capacitive element 154 (C2) and a low impedance circuit (not illustrated) are inserted between a pressure roller 153 and the ground potential. In this configuration, an electric current generated by a voltage of a dielectric withstand voltage test flows from a commercial alternating power supply 213 to a resistance heating element 151, a glass layer 152, a fixing film 100, the pressure roller 153, and the capacitive element 154 (C2). A reference number 10 represents a fixing unit, 20 represents a film unit, 150 represents a heater, and R1 represents impedance of the pressure roller 153.

If the fixing nip portion is brought into a separated state, impedance C1' of a gap 157 generated between the fixing film 100 and the pressure roller 153 in this current path is the highest, and thus most of the alternating voltage in the dielectric withstand voltage test is applied to the gap 157. A discharge phenomenon occurs in the gap 157 in accordance with a distance of the gap 157 and a voltage to be applied, and a component of a release layer which is an uppermost surface layer of the fixing film 100 is altered. Therefore, toner easily remains on a surface of the fixing film 100, and thus streaks appear periodically on an image.

SUMMARY OF THE INVENTION

The present invention is directed to an image forming apparatus in which uneven density of an image to be caused by an alternating voltage is suppressed and simultaneously a surface layer of a fixing film is protected.

According to an aspect of the present invention, an image forming apparatus includes an image bearing member, a transfer unit configured to form, together with the image bearing member, a transfer nip portion and to transfer a toner image formed on the image bearing member to a recording material at the transfer nip portion, and a fixing unit configured to fix the toner image on the recording material to the recording material, the fixing unit including a fixing film, a heater configured to generate heat by electric power supplied from a commercial alternating power supply, and a pressure roller configured to form, together with the heater, a fixing nip portion via the fixing film. The recording material on which the toner image has been formed is heated at the fixing nip portion while being nipped to be conveyed, and the toner image is fixed to the recording material. The pressure roller is grounded. A conductive path different from a power supply path from the commercial alternating power supply to the heater is provided between the commercial alternating power supply and the pressure roller, and a capacitive element is provided on the conductive path.

Further features of the present invention will become apparent from the following description of exemplary embodiments with reference to the attached drawings. Each of the embodiments of the present invention described below can be implemented solely or as a combination of a plurality of the embodiments. Also, features from different embodiments can be combined where necessary or where the combination of elements or features from individual embodiments in a single embodiment is beneficial.

DESCRIPTION OF THE EMBODIMENTS

<Configurations of Image Forming Apparatus and Fixing Unit>

Figure 5:
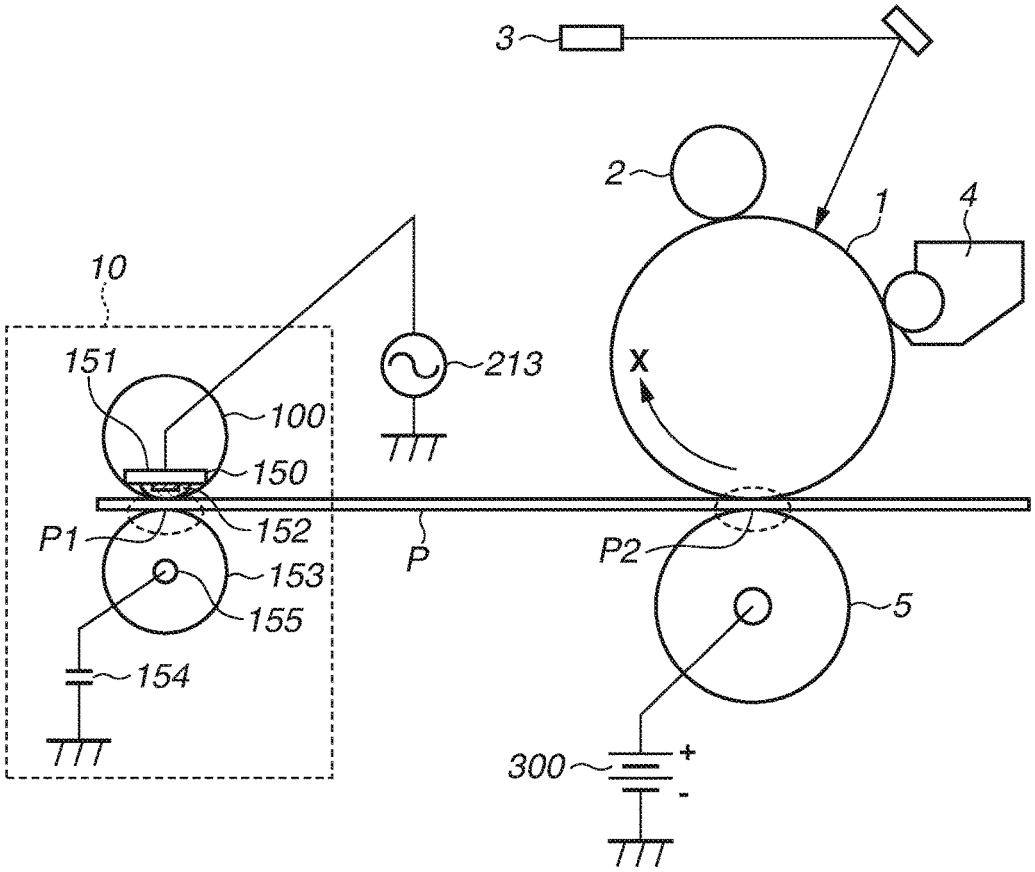
FIG. 5 is a diagram illustrating an entire outline of an image forming apparatus.
Figure 6:
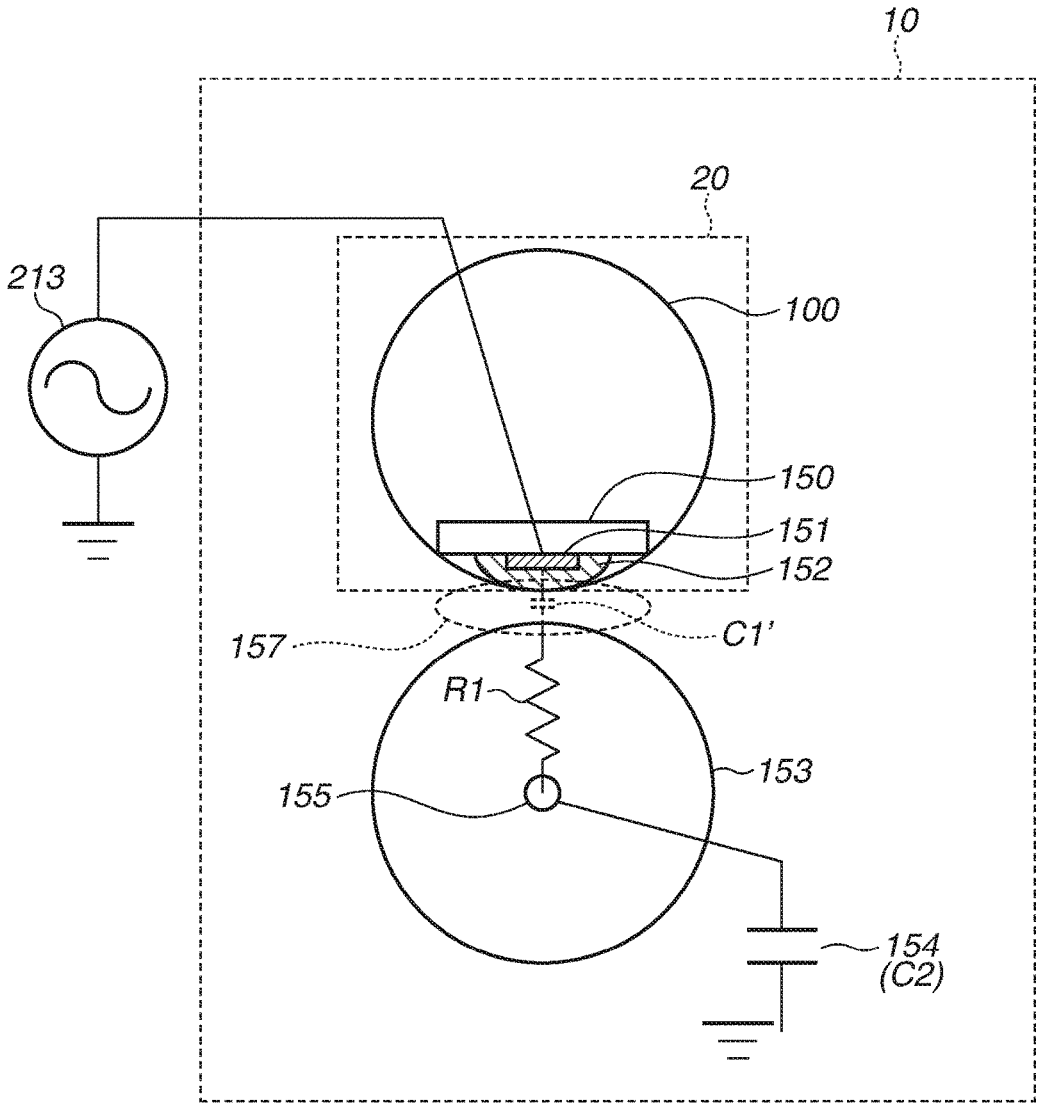
FIG. 6 is a diagram illustrating a fixing unit in the pressure released state according to a comparative example not covered by the present invention.

FIG. 5 is a schematic block diagram illustrating a main part of an electrophotographic laser beam printer (hereinafter, referred to as LBP). In FIG. 5, a photosensitive drum 1 is an image bearing member on which a photosensitive layer has been formed, and is driven to be rotated in a direction of an arrow X. A charge roller 2 is for uniformly charging a surface of the photosensitive drum 1. A laser scanner unit 3 is for scanning the photosensitive drum 1 using a laser beam whose intensity has been modulated in accordance with image data. A development unit 4 is for supplying toner to the photosensitive drum 1 and develops an electrostatic latent image formed on the photosensitive drum 1. A transfer roller 5 is for transferring a toner image formed on the photosensitive drum 1 to a recording material P. A transfer nip portion P2 is formed between the transfer roller 5 and the photosensitive drum 1. A power supply 300 is for applying a transfer bias. The recording material P to which the toner image has been transferred at the transfer nip portion P2 is sent to the fixing unit 10. While the recording material P is being nipped and conveyed between a fixing film 100 and a pressure roller 153, the recording material P is heated by heat from a heater 150. As a result, the toner image on the recording material P is fixed to the recording material P.

The fixing unit 10 includes the fixing film 100 having a tubular shape, the heater 150 that comes in contact with an inner surface of the fixing film 100, and the pressure roller 153 that forms, together with the heater 150, a fixing nip portion P1 via the fixing film 100. The fixing film 100 is configured to include a fluororesin layer as a surface layer on a polyimide layer. A conductivity-imparting substance is dispersed in the fluororesin layer. A core metal 155 of the pressure roller 153 is connected to a ground potential via a capacitor 154. The heater 150 is configured to include a resistance heating element 151 printed on a ceramic substrate. Application of an alternating voltage (supply power) to the resistance heating element 151 from a commercial alternating power supply 213 causes the resistance heating element 151 to generate heat. The heater 150 is disposed so that a glass layer 152 comes in contact with the fixing film 100. The glass layer (insulating layer) 152 which covers the resistance heating element 151 is regarded as a capacitor from an electrical aspect. In a state (pressurized state) that a pressure generated during a fixing process is applied between the heater 150 and the pressure roller 153 via the fixing film 100, a capacitance value of the glass layer 152 becomes a few hundred picofarad (pF). Therefore, the alternating voltage of the commercial alternating power supply 213 is transmitted to the fixing nip portion P1 which nips the recording material P via the glass layer 152 from the resistance heating element 151. The fixing unit 10 has a pressure-changing mechanism (not illustrated) that releases or reduces a pressure to be applied to the fixing nip portion P1.

Figure 2:
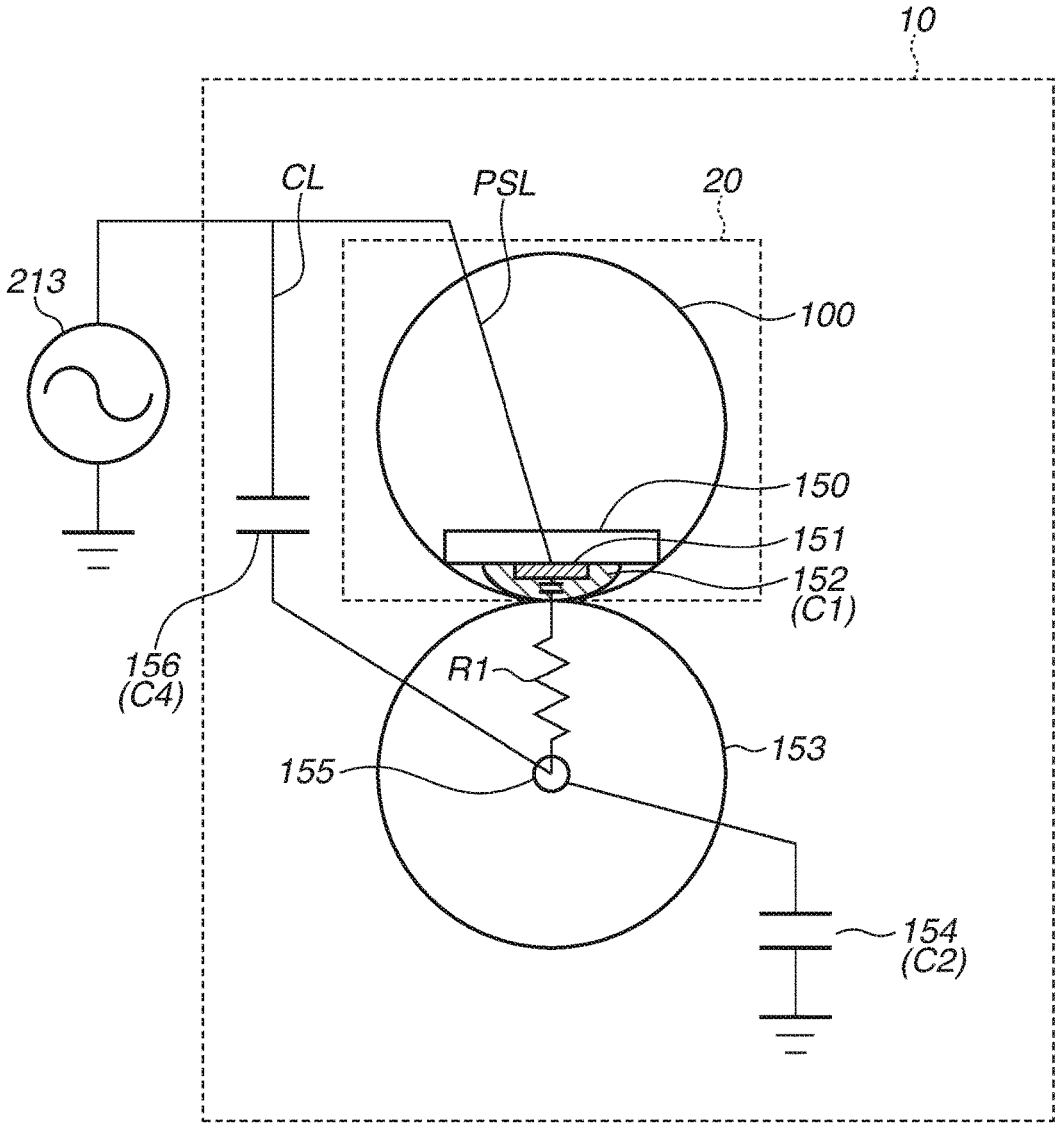
FIG. 2 is a diagram illustrating the fixing unit in a pressurized state according to the first exemplary embodiment.

FIG. 2 is a diagram illustrating the fixing unit 10 in a pressurized state. A reference symbol C1 represents a capacitance of a capacitor component to be formed between the resistance heating element 151 and a surface of the pressure roller 153 via the glass layer 152. A reference symbol C2 represents capacitance of the capacitor (second capacitive element) 154. A reference symbol R1 represents a resistance value from the surface of the pressure roller 153 through the core metal 155. The capacitor 154 has a role in reducing alternating impedance between the fixing nip portion P1 and the ground potential and in reducing an alternating voltage component to be transmitted to the transfer nip portion P2 via the recording material P. Provision of the capacitor 154 can suppress uneven density of a toner image to be transferred to the recording material P at the transfer nip portion P2. The characteristic of the present exemplary embodiment is a capacitor (capacitive element) 156 inserted between the core metal 155 of the pressure roller 153 and a power supply line from the commercial alternating power supply 213 to the resistance heating element 151 of the heater 150. Capacitance of the capacitor 156 is represented by C4. A symbol PSL represents a power supply path from the commercial alternating power supply 213 to the heater 150 (accurately, the resistance heating element 151). A symbol CL represents a conductive path different from the power supply path PSL. The conductive path CL is disposed between the commercial alternating power supply 213 and the pressure roller 153. The capacitor (capacitive element) 156 is provided on the conductive path CL.

Figure 1:
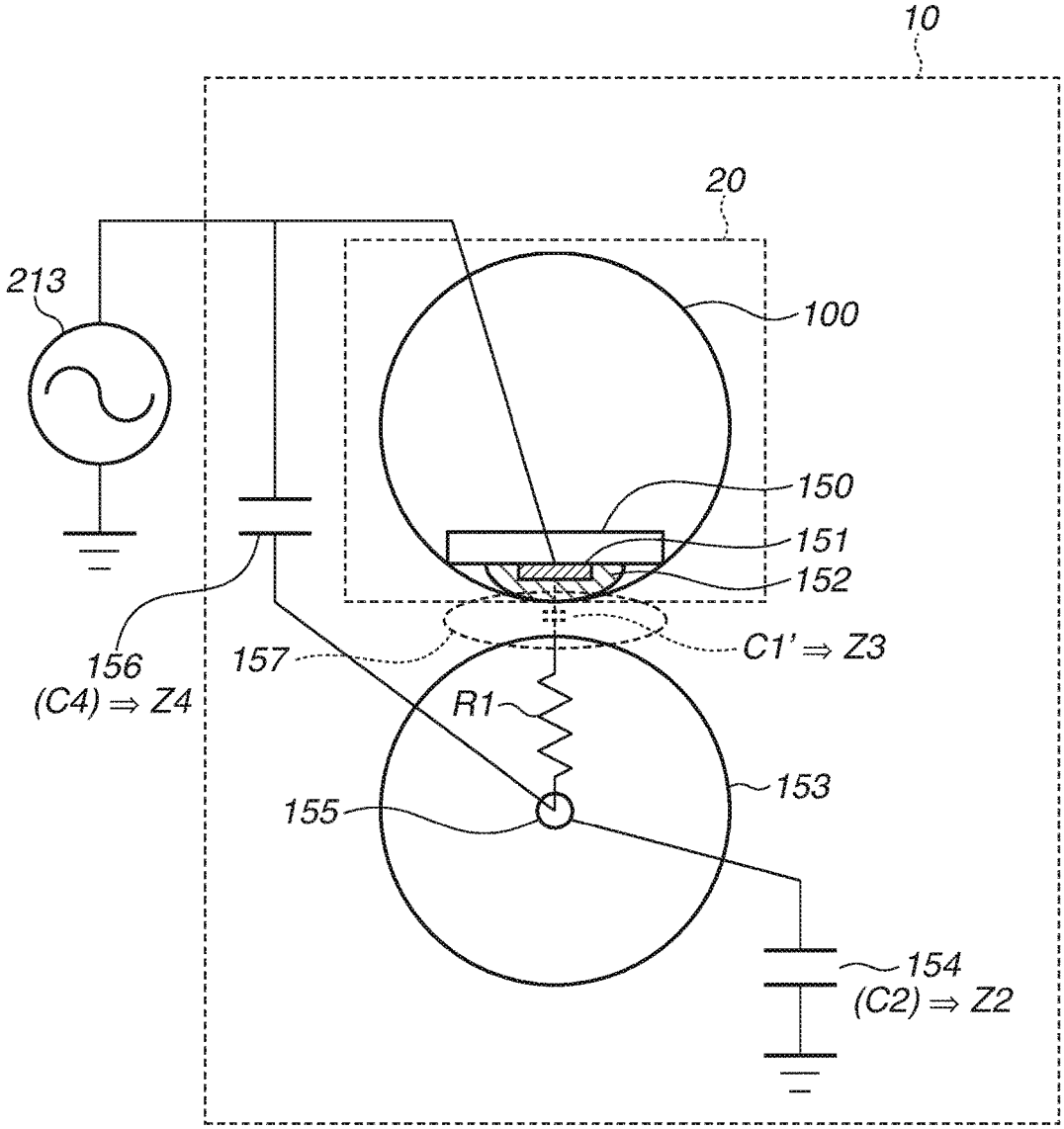
FIG. 1 is a diagram illustrating a fixing unit in a pressure released state according to a first exemplary embodiment.

On the other hand, FIG. 1 is a diagram illustrating the fixing unit 10 in a pressure released state. A slight gap 157 is generated between the fixing film 100 and the pressure roller 153. Since the capacitance C1 illustrated in FIG. 2 includes the gap 157, the capacitance C1 becomes capacitance C1' which is smaller than that in the pressurized state.

<Voltage to be Generated in Gap During Dielectric Withstand Voltage Test>

In order to solve the issue, a discharge phenomenon in the gap 157 during the dielectric withstand voltage test is necessarily suppressed. Ease of generation of the discharge phenomenon changes in accordance with a distance of the gap and a voltage to be generated in the gap.

Figure 3:
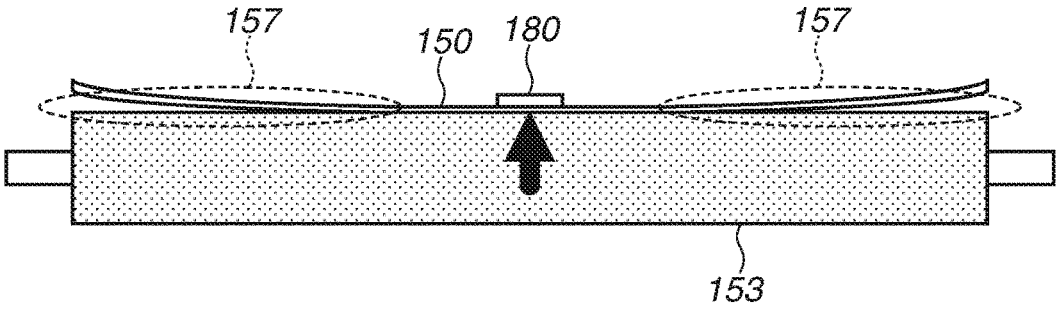
FIG. 3 is a diagram describing a gap to be generated between a fixing film and a pressure roller in the pressure released state.

As to the distance of the gap 157, FIG. 1 illustrates a state that a film unit 20 is completely separated from the pressure roller 153, but actually they partially come in contact with each other. FIG. 3 illustrates a state of the heater 150 and the pressure roller 153 in the pressure released state in a longitudinal direction. A heater holder (not illustrated) that holds the heater 150 has a crown shape such that a center portion in the longitudinal direction protrudes toward the pressure roller 153. The heater 150 also has a crown shape such that its center portion protrudes towards the pressure roller 153 in accordance with the shape of the heater holder. A safety element 180 such as a thermal switch is disposed on the center portion of the heater 150. The safety element 180 is configured to receive a pressure in a direction of an arrow in FIG. 3 from the pressure roller 153 also in the pressure released state and to come in close contact with the heater 150. Therefore, a center portion of the pressure roller, which pressurizes the safety element 180, in the longitudinal direction has a less gap.

In a case where, in this state, the pressure is further reduced to provide a large gap at the center portion as well, heat of the heater 150 is hard to be transmitted to the safety element 180. Accordingly, if power supply to the heater 150 is made to be uncontrollable by a failure, the heater 150 is cracked before the power supply to the heater 150 is interrupted by activation of the safety element 180. Therefore, enlargement of the gap 157 for avoiding the discharge phenomenon is constrained from a viewpoint of a design.

In the present exemplary embodiment, the discharge phenomenon is reduced by reducing a voltage to be applied to the gap 157. First, in FIG. 1, a voltage Vb to be applied to the gap 157 during the dielectric withstand voltage test is obtained.

The voltage in the dielectric withstand voltage test is applied via the power supply line (power supply path) PSL of the commercial alternating power supply 213, and is a sinusoidal voltage with a frequency f in a case where the ground potential is a zero volt. A voltage to be output from a dielectric withstand voltage test machine is represented by Va.

Impedance Z2 of the capacitor 154, impedance Z3 of capacitance C1' configured by the glass layer 152 and the gap, and impedance Z4 of the capacitor 156 are expressed by the following mathematical equations:

$$Z2 = j\frac{1}{2\pi fC2} \quad \text{(Equation·1)}$$

$$Z3 = j\frac{1}{2\pi fC1'} \quad \text{(Equation·2)}$$

$$Z4 = j\frac{1}{2\pi fC4} \quad \text{(Equation·3)}$$

where j represents a complex number, and expressed as j^=−1.

In the present exemplary embodiment, the frequency f of the dielectric withstand voltage test is 50 Hz (f=50 Hz), and C2=4700 pF. Further, in the pressurized state, the capacity component C1' to be configured by the glass layer 152 is about 100 pF. Since the resistance value R1 is very smaller than the impedance C1', the resistance value can be ignored. According to (Equation 1) and (Equation 2), absolute values of the impedance |Z2| and |Z3| are:

|Z2|=0.7 MΩ

|Z3|=32 MΩ.

In a case where the voltage Va in the dielectric withstand voltage test is 1800 Vrms (Va=1800 Vrms), in a configuration without the capacitor 156, the voltage Vb to be applied to the gap 157 is obtained by the following equation:

$$Vb=Va\times|Z3|/(|Z3|+|Z2|)=1760 \text{ Vrms.}$$

Therefore, it is found that most of the voltage in the dielectric withstand voltage test, Va=1800 V, is applied to the gap 157.

On the contrary, the voltage Vb in the present exemplary embodiment is obtained. The capacitor 156 to be added is set so that C4=1000 pF. Parallel composed impedance Z5 of the impedance Z3 and the impedance Z4 is obtained as follows:

$$Z5=(|Z3|\hat{}-1+|Z4|\hat{}-1)\hat{}-1=2.9M\Omega.$$

Therefore, in the case where the voltage Va in the dielectric withstand voltage test is 1800 Vrms (Va=1800 Vrms), the voltage Vb to be applied to the gap 157 is obtained as follows:

$$Vb=Va\times|Z5|/(|Z5|+|Z2|)=1450 \text{ Vrms.}$$

As expressed by the above equations, the voltage to be applied to the gap 157 is reduced by about 300 Vrms. If this condition is considered as a sinusoidal peak voltage, the voltage is reduced by about 423 Vp. The discharge phenomenon can be reduced by connecting the capacitive element 156 between the commercial alternating power supply 213 and the pressure roller 153 in such a manner, and thus the surface layer of the fixing film 100 can be protected.

The impedance Z4 of the capacitor 156 is an order of a few MΩ, while the resistance value of the resistance heating element 151 is a few Ω to a few dozen Ω. That is, the impedance Z4 of the capacitor 156 is $10^3$ times to $10^6$ times as high as the resistance value of the resistance heating element 151. For this reason, in a case where the resistance heating element 151 is caused to generate heat in order to fix a toner image to a recording material, an electric current hardly flows in the conductive path CL.

The following description about a second exemplary embodiment mainly pertains to a portion different from the first exemplary embodiment described above.

Figure 4:
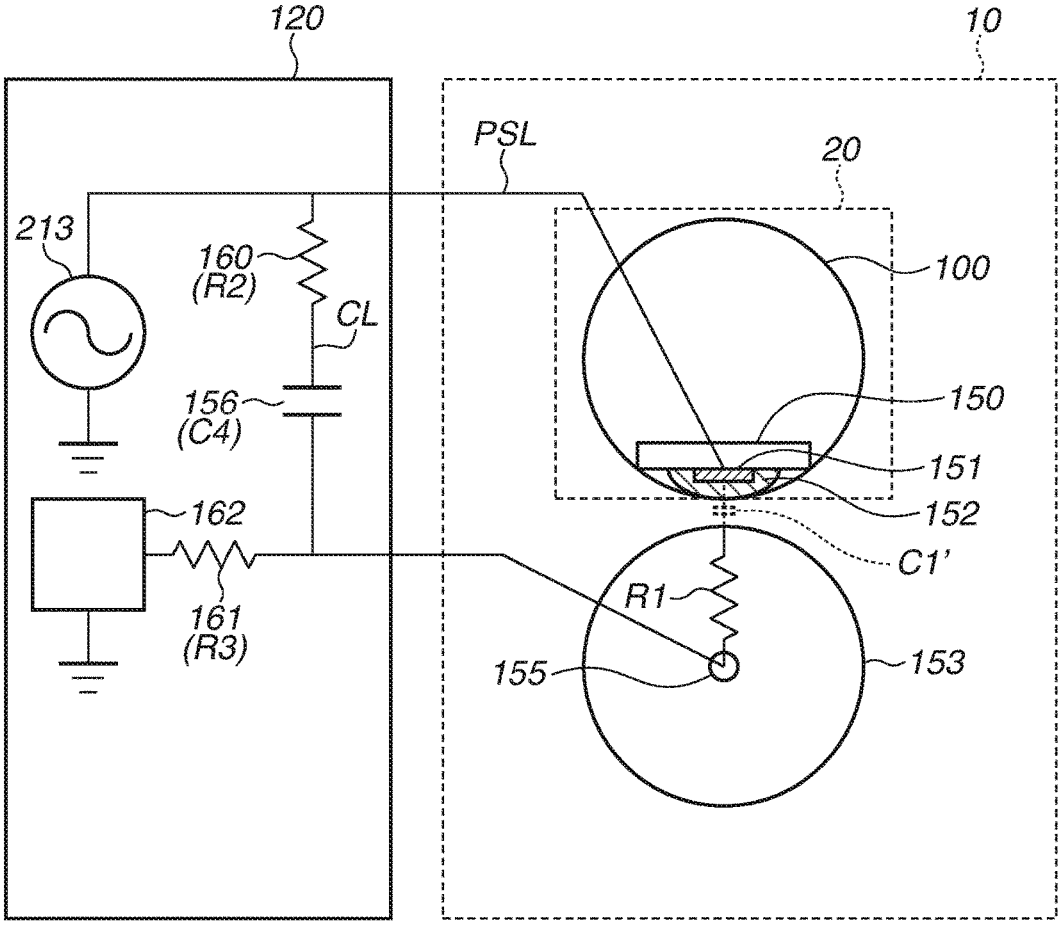
FIG. 4 is a diagram illustrating a fixing unit in the pressure released state according to a second exemplary embodiment.

In order to prevent a defective image (toner offset) during heat fixing, a high-voltage output (fixing bias) of a few hundred volts to a few kilo volts is applied to the pressure roller 153 or the surface of the fixing film 100 in some cases. FIG. 4 illustrates a substrate unit 120 having a fixing bias circuit (direct-current power supply) 162 in addition to the power supply line to the heater 150.

In place of the capacitor 154 in FIG. 1, the fixing bias circuit 162 is connected to the core metal 155 of the pressure roller 153 via an output resistance 161. The fixing bias circuit 162 outputs a direct-current voltage having the same charging polarity as that of toner. The output resistance 161 is a limiting resistor that limits an output from the fixing bias circuit. The pressure roller 153 is grounded via the fixing bias circuit. The connection of the fixing bias circuit 162 reduces impedance between the core metal 155 and the ground potential. Thus, the impedance at the gap 157 becomes relatively high, and the discharge phenomenon in the gap 157 is concerned.

Therefore, similarly to the first exemplary embodiment, the capacitor (capacitive element) 156 is inserted between the core metal 155 of the pressure roller 153 and the power supply path PSL from the commercial alternating power supply 213 to the resistance heating element 151 of the heater 150. Further, in the present exemplary embodiment, a resistor (resistance element) 160 is connected in series. A composed impedance of the capacitor 156 and the resistor 160 is adjusted so as to be equivalent to the impedance Z4 in the first exemplary embodiment, so that an effect similar to the effect in the first exemplary embodiment can be obtained.

If a resistor that fulfills an insulating condition defined by the safety standards is used as the resistor 160 in the present exemplary embodiment, the capacitor 156 approved by the safety standards does not have to be used, and thus, a degree of freedom of selecting the capacitor 156 is improved.

While the present invention has been described with reference to exemplary embodiments, it is to be understood that the invention is not limited to the disclosed exemplary embodiments.

This application claims the benefit of Japanese Patent Application No. 2017-086451, filed Apr. 25, 2017, which is hereby incorporated by reference herein in its entirety.

What is claimed is:

1. An image forming apparatus comprising:

an image bearing member;

a transfer unit configured to form, together with the image bearing member, a transfer nip portion and to transfer a toner image formed on the image bearing member to a recording material at the transfer nip portion; and a fixing unit configured to fix the toner image on the recording material to the recording material at a fixing nip portion, the fixing unit including a fixing film, a heater configured to generate heat from electric power supplied from a commercial alternating power supply, and a pressure roller configured to form, together with the heater, the fixing nip portion via the fixing film, wherein the pressure roller is electrically grounded, wherein a conductive path different from a power supply path from the commercial alternating power supply to the heater is provided between the commercial alternating power supply and the pressure roller, wherein one end of the power supply path is connected with the commercial alternating power supply and the other end of the power supply path is connected with the heater, wherein one end of the conductive path is connected with the commercial alternating power supply or the power supply path and the other end of the conductive path is connected with the pressure roller, and wherein a capacitive element is provided on the conductive path.

2. The image forming apparatus according to claim 1, further comprising a second capacitive element connected between the pressure roller and a ground potential.

3. The image forming apparatus according to claim 1, further comprising a direct-current power supply configured to apply a direct-current voltage to the pressure roller, wherein the pressure roller is grounded via the direct-current power supply.

4. The image forming apparatus according to claim 3, wherein a resistance element connected to the capacitive element in series is provided to the conductive path.

5. The image forming apparatus according to claim 1, wherein the heater includes a substrate and a resistance heating element that is disposed on the substrate and is configured to generate heat from the electric power supplied via the power supply path, and wherein impedance of the capacitive element is $10^3$ times to $10^6$ times a resistance value of the resistance heating element.

6. The image forming apparatus according to claim 5, wherein the heater includes an insulating layer that covers the resistance heating element, at least in the direction of the pressure roller.

7. The image forming apparatus according to claim 6, wherein the insulating layer is configured to contact the fixing film.

8. The image forming apparatus according to claim 7, wherein the insulating layer is a glass layer.

9. The image forming apparatus according to claim 1, wherein the fixing unit includes a pressure-changing mechanism that is configured to release or reduce the pressure to be applied between the pressure roller and the fixing film at the fixing nip portion.

* * * * *